US009572463B2

(12) United States Patent
Conrad

(10) Patent No.: US 9,572,463 B2
(45) Date of Patent: Feb. 21, 2017

(54) SURFACE CLEANING APPARATUS WITH OPENABLE FILTER COMPARTMENT

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 234 days.

(21) Appl. No.: 14/384,031

(22) PCT Filed: Feb. 28, 2013

(86) PCT No.: PCT/CA2013/000181
§ 371 (c)(1),
(2) Date: Sep. 9, 2014

(87) PCT Pub. No.: WO2013/131170
PCT Pub. Date: Sep. 12, 2013

(65) Prior Publication Data

US 2015/0026915 A1 Jan. 29, 2015

Related U.S. Application Data

(60) Provisional application No. 61/608,864, filed on Mar. 9, 2012.

(51) Int. Cl.

| | |
|---|---|
| ***A47L 5/28*** | (2006.01) |
| ***A47L 9/12*** | (2006.01) |
| ***A47L 9/20*** | (2006.01) |

(52) U.S. Cl.
CPC .. *A47L 5/28* (2013.01); *A47L 9/12* (2013.01); *A47L 9/122* (2013.01); *A47L 9/127* (2013.01); *A47L 9/20* (2013.01)

(58) Field of Classification Search
CPC ..... A47L 5/28; A47L 9/122; A47L 9/127; A47L 9/20; A47L 9/12
See application file for complete search history.

(56) References Cited

U.S. PATENT DOCUMENTS

| | | | | |
|---|---|---|---|---|
| 6,868,579 | B2 * | 3/2005 | Yang | A47L 9/127 15/327.1 |
| 7,076,831 | B1 | 7/2006 | Ji et al. | |
| 9,204,769 | B2 * | 12/2015 | Conrad | A47L 5/225 |

FOREIGN PATENT DOCUMENTS

| | | | |
|---|---|---|---|
| CA | 2658014 | A1 | 9/2010 |
| EP | 1321087 | A1 | 6/2003 |
| EP | 2229855 | A2 | 9/2010 |
| GB | 2391459 | A | 2/2004 |
| WO | 99/30602 | A2 | 6/1999 |
| WO | 2005/053494 | A2 | 6/2005 |
| WO | 2010/102396 | A1 | 9/2010 |

* cited by examiner

*Primary Examiner* — David Redding
(74) *Attorney, Agent, or Firm* — Philip C. Mendes da Costa; Bereskin & Parr LLP/S.E.N.C.R.L., s.r.l.

(57) ABSTRACT

An upright surface cleaning apparatus is provided wherein the upper section is provided with an openable post motor filter housing. The post motor filter may be axially removable and may be positioned below the suction motor.

12 Claims, 8 Drawing Sheets

SURFACE CLEANING APPARATUS WITH OPENABLE FILTER COMPARTMENT

CROSS-REFERENCE TO RELATED APPLICATIONS

This application is the U.S. National Phase under 35. U.S.C. §371 of International Application PCT/CA2013/000181, filed Feb. 28, 2013, which claims the benefit of U.S. Provisional Application No. 61/608,864, filed Mar. 9, 2012. The disclosures of the above-described applications are hereby incorporated by reference in their entirety.

FIELD

This invention relates to a surface cleaning apparatus and, in particular, an upright surface cleaning apparatus which has an openable filter chamber. In a particular embodiment, the upright surface cleaning apparatus has a post motor HEPA filter which is positioned beneath the suction motor and the post motor filter housing is axially openable.

INTRODUCTION

Various different constructions for a surface cleaning apparatus such as a vacuum cleaner are known in the art. Currently, upright vacuum cleaners which utilize cyclonic cleaning stages are known. Such devices may use one or two cyclonic cleaning stages. Typically, a post motor filter, such as a HEPA filter, is provided. The post motor HEPA filter is provided to filter carbon dust and other fine particular matter which is in the clean air stream after passing by the suction motor.

An example of such a configuration is the United States patent application published under number 2011/0219579. This design shows a cyclonic upright vacuum cleaner having a single cyclonic cleaning stage. The suction motor is positioned beneath the dirt collection chamber. A post motor filter chamber comprises part of the front portion of the suction motor housing and is defined by a chamber parallel to the front surface of the suction motor housing and covered by an openable grill. A post motor filter is provided behind the grill. During operation, the post motor filter may get clogged with fine particular matter. Accordingly, the grill may be opened to allow the post motor filter to be removed for, e.g. washing or replacement.

SUMMARY

The carpet cleaning efficiency of a vacuum cleaner depends upon the velocity of the air flow at the dirty air inlet in the floor or surface cleaning head. The greater the velocity, the more dirt, and the heavier the dirt particles, which may be entrained in the air stream that is drawn into the vacuum cleaner by the dirty air inlet. As a post motor filter becomes clogged, the back pressure through the vacuum cleaner will increase thereby reducing the velocity of the air flow at the dirty air inlet. Accordingly, the post motor filter should be cleaner or replaced occasionally. Typically, consumers may not clean or replace this filter. Accordingly, the performance of a vacuum cleaner will decrease over time.

In accordance with one broad aspect of this disclosure, a post-motor filter with an enhanced upstream surface area is provided. The post-motor filter is positioned and configured so as to enhance the upstream surface area of the post-motor filter while, at the same time, not increasing or limiting the increase in the foot print of the surface cleaning apparatus, thereby maintaining the maneuverability of the surface cleaning apparatus.

In accordance with another broad aspect of this disclosure an upright surface cleaning apparatus is provided wherein the post motor filter housing and the post motor filter are positioned beneath the suction motor. Preferably, the post motor filter housing is axially openable (e.g. it may be removed in a downward direction). An advantage of this design is that a post motor filter having a larger upstream surface area may be provided. Increasing the size of the upstream surface area of a post motor filter (all other design parameters remaining constant) reduces the back pressure and assists in maintaining the cleaning efficiency of a vacuum cleaner over extended period of time. For example, the post motor filter may be annular in shape and may have an outer or upstream surface that is pleated.

In accordance with another broad aspect of this disclosure, an upright surface cleaning apparatus is provided wherein the upper section comprises a suction motor and a post motor filter and the post motor filter is axially removable. Preferably, the post motor filter chamber is also axially openable. An advantage of this construction is that a post motor filter chamber may be provided which may be sealed to prevent air exiting the post motor filter chamber and by passing the post motor filter while enabling a post motor filter having a larger upstream surface area.

In accordance with one aspect of this disclosure there is provide an upright surface cleaning apparatus surface cleaning apparatus comprising:

- an air flow path extending from a dirty air inlet to a clean air outlet and including an air treatment member and a suction motor, the suction motor having a suction motor axis that defines an axis of rotation of an impeller;
- a surface cleaning head having the dirty air inlet; and,
- an upper section moveably mounted to the surface cleaning head between an upright storage position and an inclined in use position, the upper section comprising the suction motor and a post motor filter provided in an openable post motor filter housing
  - wherein the post motor filter is positioned below the suction motor.

In accordance with another aspect of this disclosure, there is provided an upright surface cleaning apparatus comprising:

- an air flow path extending from a dirty air inlet to a clean air outlet and including an air treatment member and a suction motor, the suction motor having a suction motor axis that defines an axis of rotation of an impeller;
- a surface cleaning head having the dirty air inlet; and,
- an upper section moveably mounted to the surface cleaning head between an upright storage position and an inclined in use position, the upper section comprising the suction motor and a post motor filter provided in an openable post motor filter housing
- wherein the post motor filter is axially removable.

Any of the surface cleaning apparatus disclosed herein may have one or more of the following features.

The post motor filter may be annular.

The air exiting the suction motor may travel axially through the post motor filter.

The post motor filer housing may include an openable portion and the openable portion may be axially removable.

The post motor filer housing may include an openable portion that includes a sidewall and the post motor filter may be positioned in the openable portion when the openable portion is opened.

The post motor filter may be axially removable.

The post motor filer housing may include an openable portion that includes a sidewall and the clean air outlet is provided in the sidewall.

The post motor filter may be a HEPA filter.

The post motor filter housing may be openable by a hand operable closure member.

The post motor filter housing may be openable by a hand operable rotatable closure member.

The upper section may comprise a removable cleaning unit, the removable cleaning unit comprising the air treatment member, the suction motor, the post motor filter and the post motor filter housing.

The post motor filter housing may be axially removable.

The post motor filter maybe axially spaced from the suction motor.

The post motor filter maybe concurrently axially removable with an openable portion of the post motor filter housing.

DRAWINGS

These and other advantages of the surface cleaning apparatus of this disclosure will be more fully and completely understood in conjunction with the following description of the preferred embodiments of the disclosure in which:

FIG. 7 is a perspective view from above of the openable section of the post-motor filter chamber of FIG. 1 with the post-motor filter provided therein; and.

DESCRIPTION OF VARIOUS EMBODIMENTS

Figure 1:
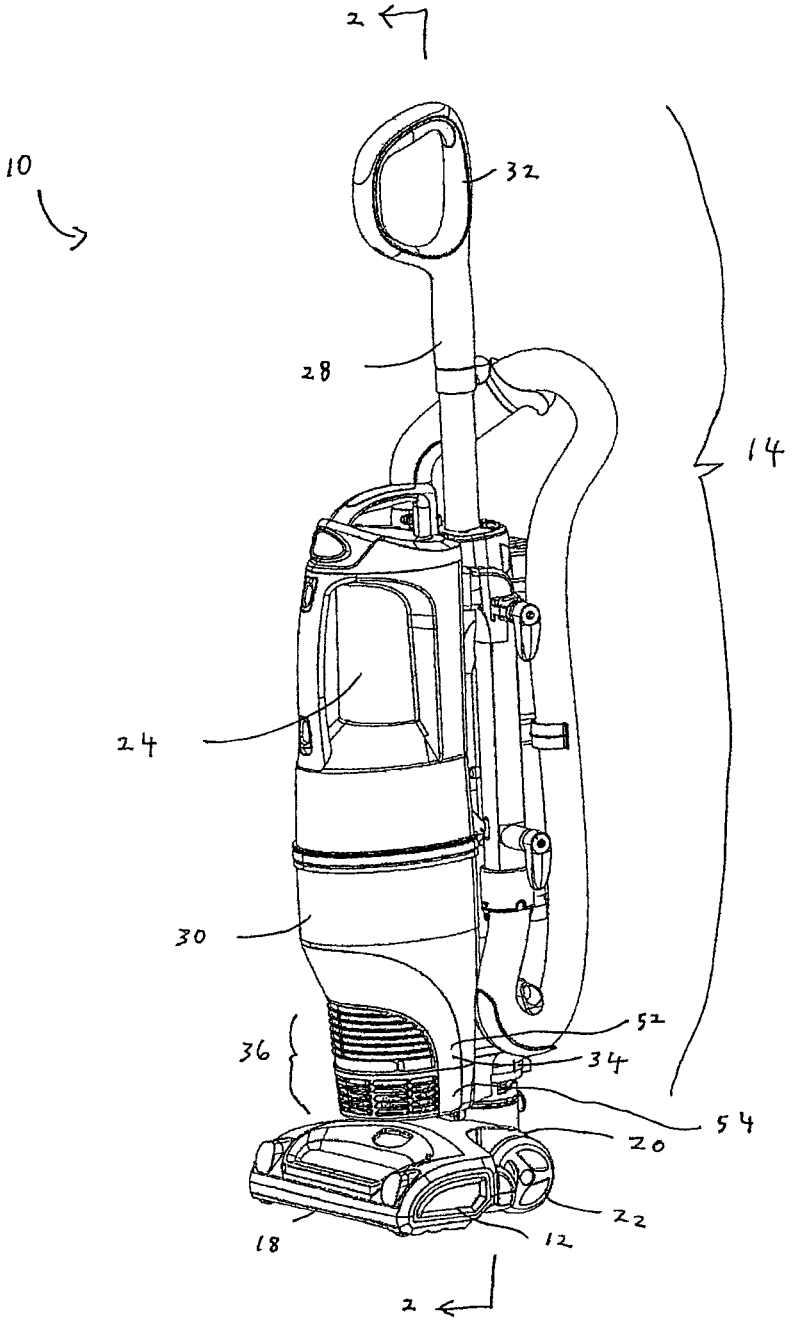
FIG. 1 is a perspective view of a vacuum cleaner according to a preferred embodiment.
Figure 2:
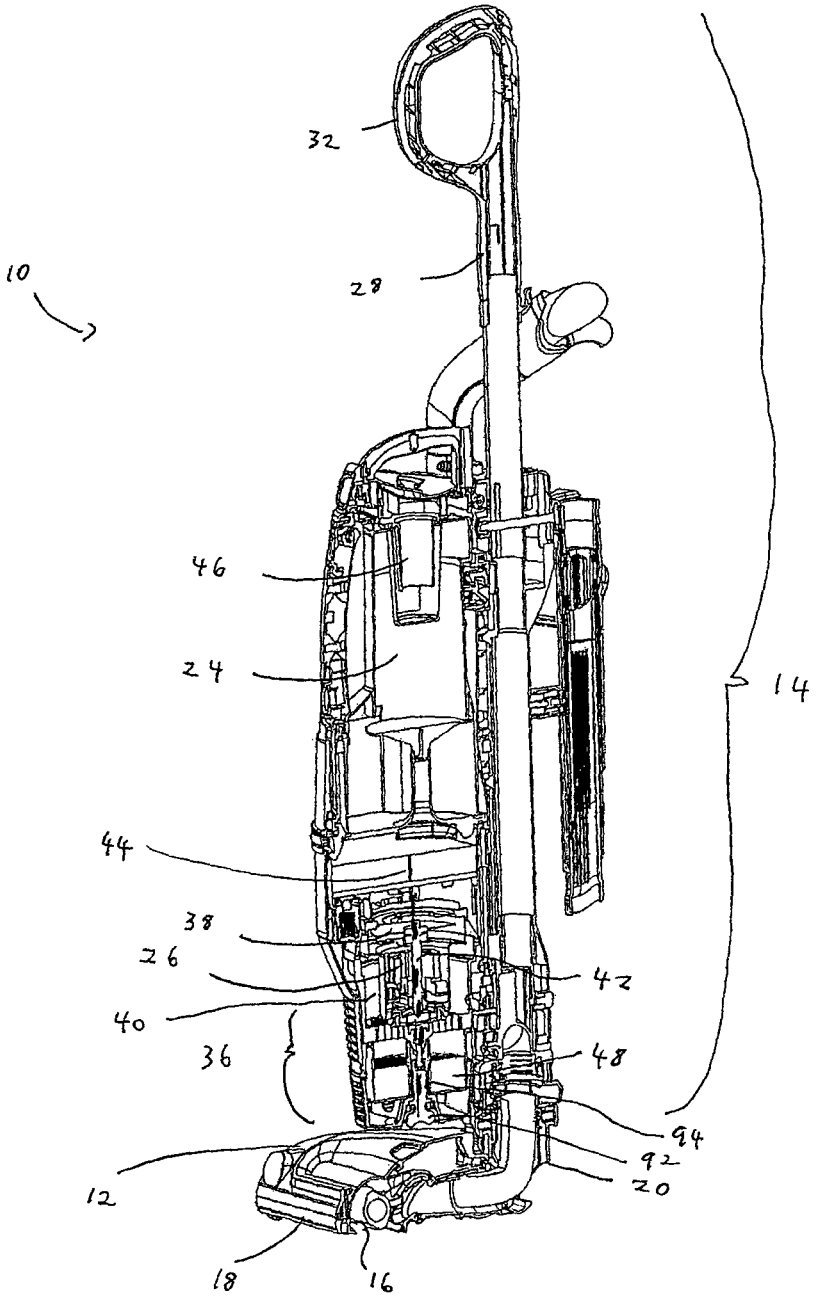
FIG. 2 is a vertical section along the line 2-2 in FIG. 1.

FIGS. 1 and 2 exemplify an upright surface cleaning apparatus 10. As exemplified therein, upright surface cleaning apparatus 10 comprises a surface cleaning head or floor cleaning head 12 and an upper section 14 which is moveably mounted to surface cleaning head 12.

Surface cleaning head 12 may be any surface cleaning head known in the art. As exemplified, surface cleaning head 12 has a dirty air inlet 16, a front end 18, a rear end 20 and optionally, a plurality of wheels 22.

Upper section 14 is moveably mounted (e.g. pivotally mounted) to surface cleaning head 12 by any means known in the art and is movable between an upright storage position as exemplified in FIGS. 1 and 2 and an inclined in use position. For example, when it is desired to use surface cleaning apparatus 10, a user may grasp hand grip portion 32 of handle 28 so as to move upper section 14 into a reclined position as is typically used with vacuum cleaners.

Upright section 14 may be any upright section known in the art. Preferably, as exemplified, upright section 14 has one or more air treatment members, such as cyclone 24, a suction motor 26 and a handle 28. Suction motor 26 may be provided in a suction motor housing 30. Upper section 14 is also provided with post-motor filter housing 34 which houses post-motor filter 48 and which may house the clean air outlet 36.

As exemplified, clean air outlet 36 comprises a grill on a forward face of post-motor filter housing 34 as well as a portion of suction motor housing 30. It will be appreciated that the clean air outlet 36 may be provided in the variety of locations such as on a portion or all of one or both of suction motor housing 30 and post motor filter housing 34. Alternately, or in addition, clean air outlet 36 may be provided on the end of post-motor filter housing 34 distal to suction motor 26. For example, lower surface 50.

It will be appreciated that surface cleaning apparatus 10 may utilize any air treatment member or members known in the art. Preferably the air treatment member comprises at least one cyclone and may utilize a plurality of cyclonic cleaning stages. Other air treatment members such as filter bags or the like may also be used. It will also be appreciated that one or more of the air treatment members may be provided elsewhere, such as in floor cleaning head 12. Further, if used, cyclone 24 may be of any design.

Preferably, as exemplified, suction motor 26 is positioned below cyclone 24, and accordingly, may be provided in or as a lower portion of upper section 14. The suction motor may be any known in the art and may comprise an impeller, rotary blade or the like 38 which is mounted an axle 42 that is driven by motor 40. Axle 42 defines suction motor axis 44. It will be appreciated that suction motor 26 may be of any design known in the surface cleaning arts. It will be appreciated that, in alternate embodiments, suction motor 26 may optionally be provided above cyclone 24, for example, at the upper end of upper section 14 or in surface cleaning head 12.

In operation, air is drawn in through dirty air inlet 16 and transferred via one or more conduits to cyclone 24. The air exits cyclone 24 via cyclone air outlet 46 and is then conveyed by one or more conduits to a position above suction motor 26. The air passes through impeller 28 and by motor 40. After passing through post-motor filter 48, the air exits via clean air outlet 36.

Figure 5:
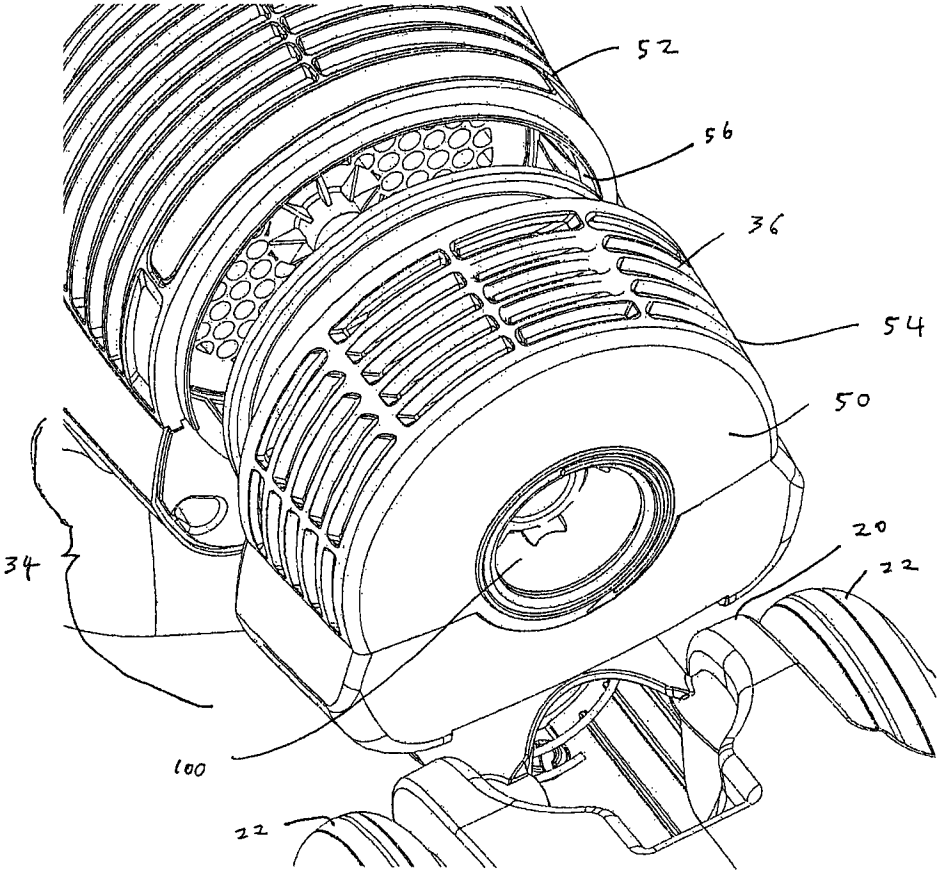
FIG. 5 is a perspective view from below of the post-motor filter chamber of the vacuum cleaner of FIG. 1 being opened.
Figure 6:
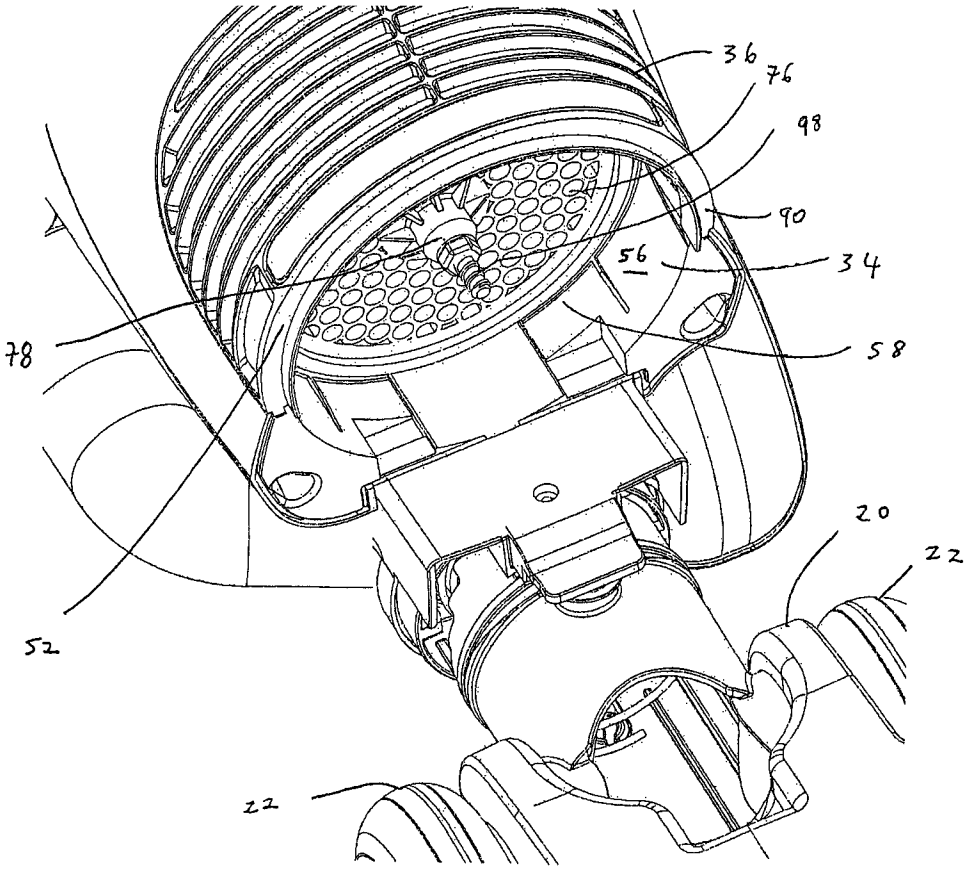
FIG. 6 is a perspective view from below of the upright section of the vacuum cleaner of FIG. 1 wherein the post-motor filter has been removed.
Figure 7:
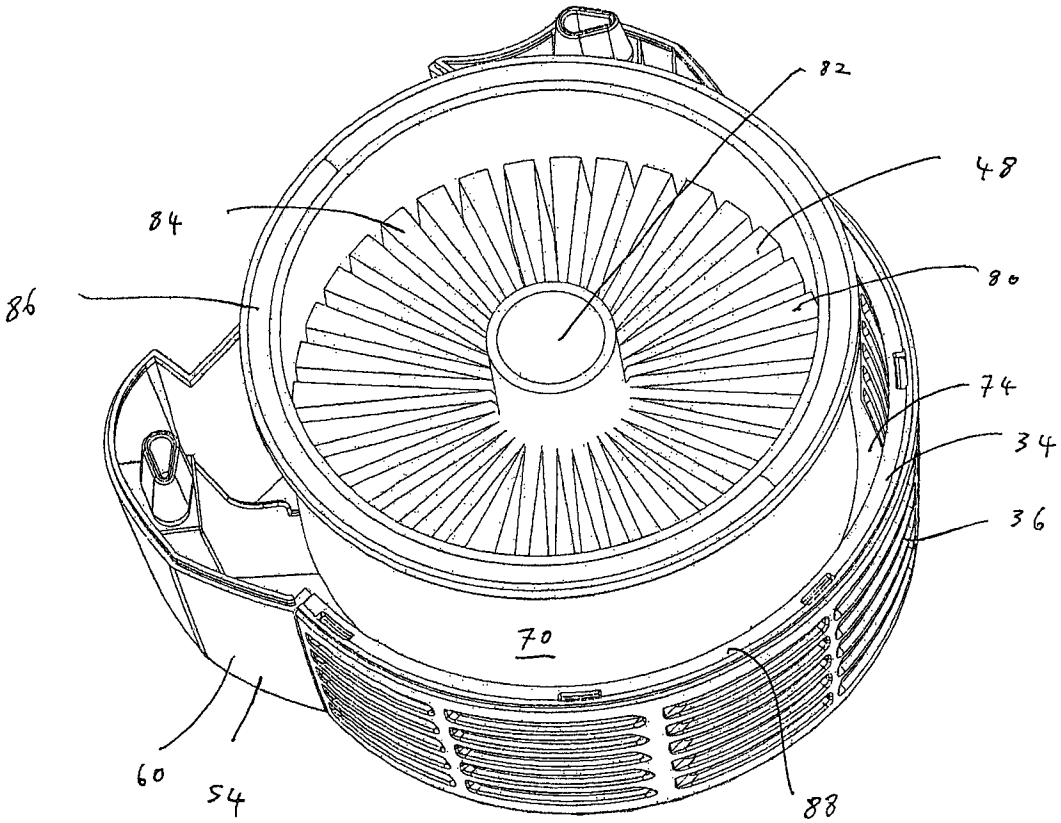

As exemplified in FIGS. 5-7, post-motor filter housing 34 is openable. As shown, post-motor filter housing 34 comprises an upper stationary portion 52 and a lower movable or openable portion 54. When in the closed configuration, the upper and lower portions 52, 54 define a chamber that houses post-motor filter 48. It will be appreciated that post-motor filter housing 34 may be of various sizes and shapes based, inter alia, on the size and shape of post-motor filter 48.

Referring to FIG. 6, stationary portion 52 may comprise a cavity 60 in which a portion or all of post-motor filter 48 may be received. Accordingly, stationary portion 52 may include a side wall 56 that surrounds a portion of cavity 60. It will be appreciated that, in some embodiments, a stationary portion 52 may not be provided. Accordingly, the sidewall of post-motor filter housing 48 may be provided on openable portion 54. Alternately, it will be appreciated that, for example, only lower end 50 may be removable. Accordingly, all of the side wall which defines the chamber in which post motor filter 48 is received may be stationary, i.e. may remain with the stationary portion 52 when the post motor filter chamber is opened. Alternately, the side wall 56 provided on openable portion 54 may extend only part way around filter housing 48 and may define an open area through which post-motor filter 48 may be removed.

Figure 8:
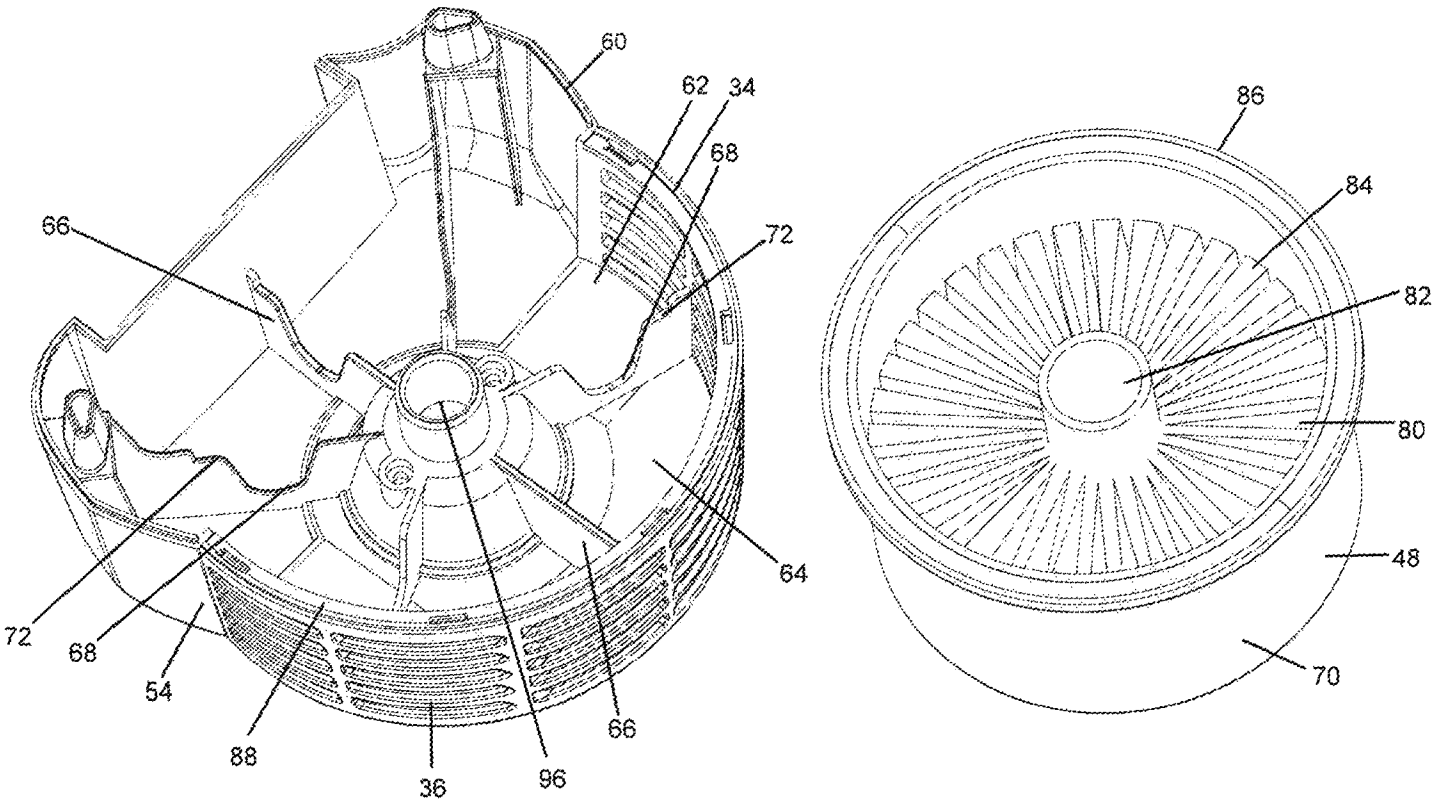
FIG. 8 is a perspective view from above of the openable section of the post-motor filter chamber of FIG. 7 with the post-motor filter removed from the openable section of the post-motor filter chamber.

In a particular preferred embodiment as exemplified in FIGS. 7 and 8, openable portion 54 includes a sidewall 60, which preferably includes a portion or all of clean air outlet 36. Sidewall 60 extends upwardly along at least a portion of, and optionally along the entire height of, post motor-filter 48 so as to provide a cavity 62 in which some or all of post motor filter 48 may be received. An advantage of this design is that a consumer need not handle post motor filter 48 when removing post motor filter 48 from surface cleaning apparatus 10. For example, openable portion 54 may effectively comprise a holder in which filter 48 is seated while it is removed from the surface cleaning apparatus. Further, in optional embodiments, filter 48 could be optionally washed while held in openable portion 54.

Preferably, post motor filter 48 is seated above lower surface 64. This is particularly desired if lower surface 64 is solid (i.e. the air does not exit through lower end 50 of post motor filter housing 34). As exemplified, lower surface 64 of openable portion 54 may be provided with a plurality of ribs 66 on which post-motor filter 48 may be seated and held securely in position. Ribs 66 may be configured so as to retain post motor filter 48 above lower surface 64. In addition, post motor filter 48 is preferably sized so as to be spaced from some or all of sidewall 60. Accordingly, air may flow axially through the filter 48 and then travel across the bottom of filter 48 to an annular space or region 74 between sidewall 70 of post motor filter 48 and sidewall 60 so as to exit via clean air outlet 36.

As exemplified, ribs 66 are provided with cutouts or notches 68 and have an upper surface 72 (see FIG. 8). Accordingly, the lower end of sidewall 70 of post motor filter 48 or the bottom of post motor filter 48 may seat on upper surface 72 of rib 66 and be spaced from lower surface 64. Air may travel through notches 64 across the bottom of the post motor filter chamber and travel upwardly through annular region 74 between sidewall 70 and sidewall 60 so as to enable air to exit through clean air outlet 36 after passing through post motor filter 48.

As exemplified in FIG. 6, the lower end of the suction motor chamber may be provided with a grill 76 so as to define a finger shield to prevent the user from inserting their hand upwardly into the suction motor chamber. Grill 76 may be of any design and may have a plurality of openings and perforations as exemplified. In addition, grill may optionally be provided with a hub 78 in which a bearing that receives the suction motor axle 42 may be housed.

Openable portion 54 may be openably attached to upper section 14 and preferably, suction motor housing 30, by any means known in the art. For example, openable portion 54 may be moveably mounted between a closed position and an open position, e.g. it may be pivotally openable about an axis that is spaced from but parallel to axle 42 or is transverse thereto. Alternately, and preferably, openable portion 54 is removable and is preferably axially removable.

As exemplified in FIGS. 7 and 8, post motor filter 48 is also preferably axially removable from upper section 14 and may be concurrently axially removable with openable portion 54. However, it will be appreciated that if post motor filter 48 is not removed with openable portion 54, then post motor filter 48 may be removable, e.g., laterally (e.g. forwardly) if a stationary portion 52 is not provided or, if a stationary portion 52 is provided, a sidewall 56 which would block the lateral movement of post motor filter 48 is not provided (e.g. the portion of the sidewall at the front of stationary portion 52 may be removable with the openable portion).

As exemplified, by positioning post motor filter 48 axially aligned with (e.g. below) suction motor 26, a relatively large upstream surface area 80 may be provided. As exemplified, post motor filter 80 is annular in shape. As used herein, the word annular is used to include a member whose outer surface is preferably round and preferably has an internal opening 82 for receipt therethrough of, e.g., a closure member as discussed subsequently. It will be appreciated that filter 48 may have an exterior which is polygonal in shape (e.g. hexagonal). Further, if a closure member is not required to penetrate through post motor filter 48, then an internal opening 82 may not be provided.

Preferably, as exemplified, the filter media 84 of post motor filter 48 may be pleated and secured (e.g. glued) into a post motor filter housing 86. Filter media 84 is preferably a HEPA filter media but alternate filter medias may be utilized.

Openable portion 54 may be securable in position by any means known in the art. As it will be appreciated, a sealing gasket or the like may be provided on the perimeter of the upper surface 88 of openable portion 54 and/or lower surface 90 of the perimeter of the stationary portion 52. For example, openable portion may be secured in position, by e.g., one or more latches or one or more screws or the like. Preferably, openable portion 54 is removably held in position by hand operable closure member, and preferably, a hand operably rotatable closure member, such a wing nut or the like.

For example, as exemplified in FIGS. 2, 6, 7 and 8, a wing nut 92 having a shaft 94 may be inserted through hub 96 of openable portion 54 and hub 82 of post motor filter 48 and be secured to a securing member, such as threaded member or shaft 98 provided on grill 76. Accordingly, as exemplified, the distal end of shaft 94 from the hand operable portion 102 may have a hollow interior shaft which is provided with mating threads for rotational mounting on threaded member 98. In alternate design, it will be appreciated that shaft 94 may be received in a cavity provided on threaded member 98 and, accordingly, threaded member 98 may have an internal threaded shaft. Alternately, a bayonet mount or the like may alternately be used. Further, it will be appreciated that a plurality of such closure members may be provided which pass through annular region 74 and therefore do not have to penetrate through an annular post motor filter 48. It will also be appreciated that a sealing gasket or the like may be provided on the upper end of hub 82 and/or mating hub 78 so as to reduce or eliminate air by passing filter media 84.

Figure 3:
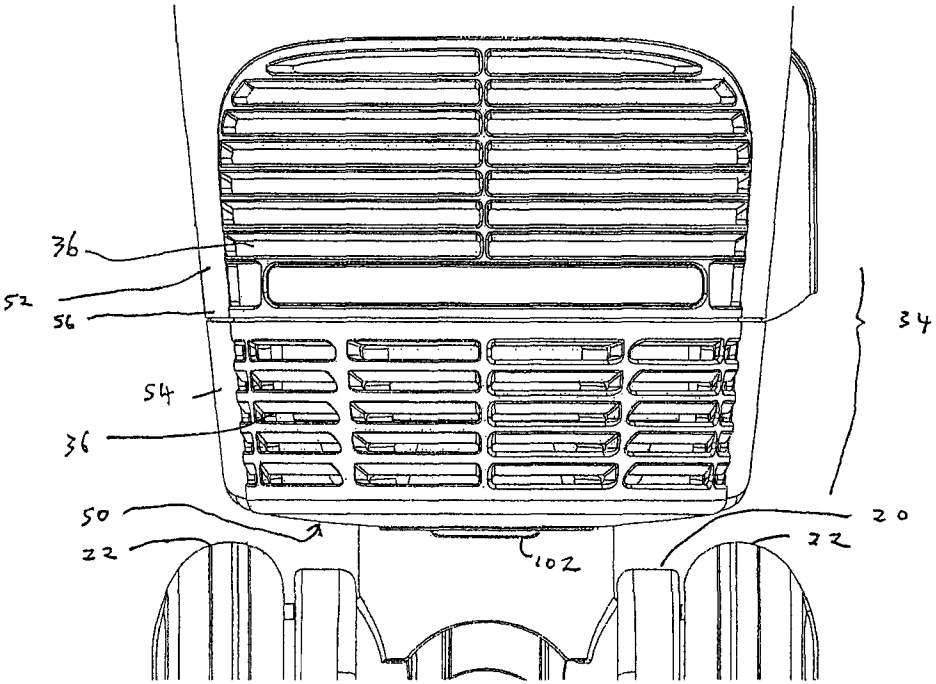
FIG. 3 is enlargement of the front of the post-motor filter chamber of the vacuum cleaner of FIG. 1.
Figure 4:
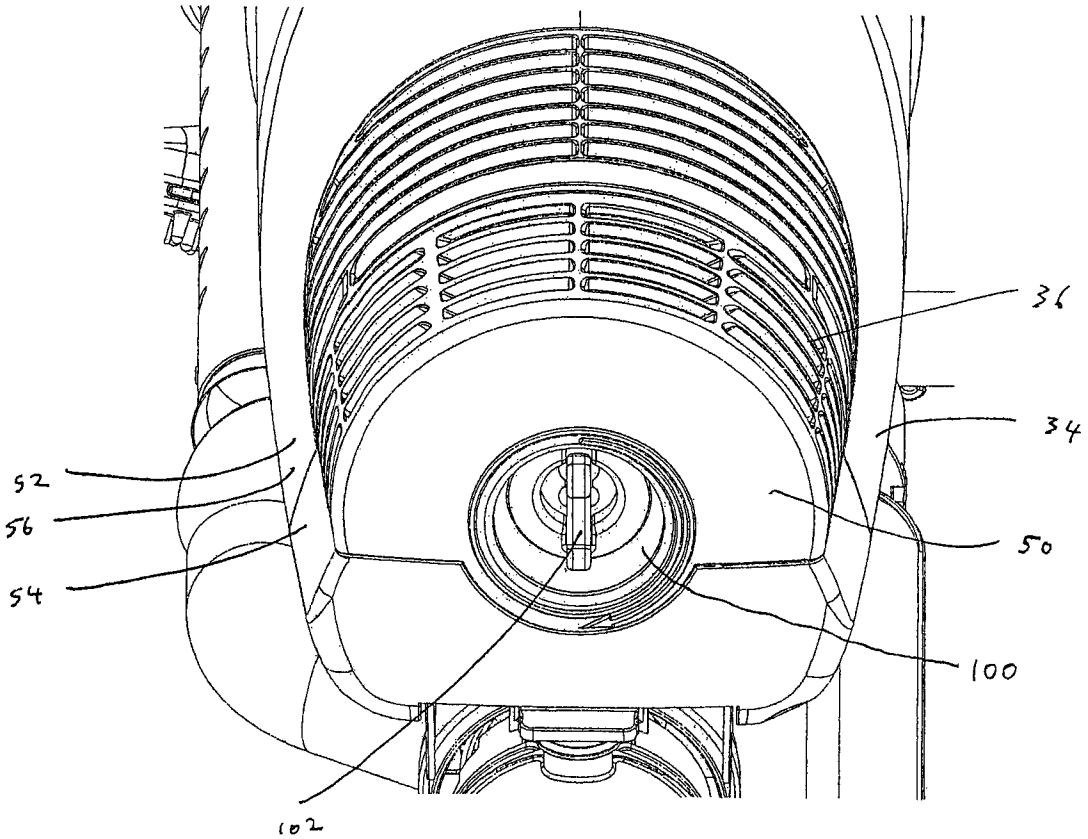
FIG. 4 is a perspective view from below of the post-motor filter chamber of the vacuum cleaner of FIG. 1.

As exemplified in FIG. 3-5, lower end 50 may have a recess 100 provided therein. Recess 100 provides a region in which some or all of the hand operable portion 102 of e.g. wing nut 92, may be received.

As shown in particular in FIG. 3, lower end 50 of the post motor filter housing 54, which may in fact be the lower end of upper section 14, may be provided immediately adjacent the upper surface of surface head 12. In this way, the size of the post motor filter 48 may be maximized thereby enabling a post motor filter to have an upstream surface area which is enhanced.

In some embodiments, the air treatment member and the suction motor may be removable as a cleaning unit (a portable cleaning unit) from upper section 14. For example, cyclone 24, the motor housing 30 and the post motor filter housing 34 may be assembled as a unit which is removably attached to the upright section and usable as a pod or hand vacuum cleaner. An example is shown in United States patent application published under number 2008/0178420, the disclosure of which is incorporated herein.

It will be appreciated that the following claims are not limited to any specific embodiment disclosed herein. Further, it will be appreciated that one or more of the features disclosed herein may be used in any particular combination or sub-combination. Further, what has been described herein has been intended to be illustrative of the invention and non-limiting and it will be understood by a person skilled in the art that other variants and modifications may be made without departing from the scope of the invention as defined in the claims appended hereto.

What is claimed is:

1. An upright surface cleaning apparatus comprising:

(a) an air flow path extending from a dirty air inlet to a clean air outlet and including an air treatment member and a suction motor, the suction motor having a suction motor axis that defines an axis of rotation of an impeller;

(b) a surface cleaning head having the dirty air inlet, a front end and a rear end; and, (c) an upper section moveably mounted to the surface cleaning head between an upright storage position and an inclined in use position; and, (d) wherein the upper section comprises a removable cleaning unit, the removable cleaning unit comprising the air treatment member, the suction motor and a post motor filter provided in an openable post motor filter housing, wherein the post motor filter is positioned below the suction motor and wherein the clean air outlet is provided in a wall of the upper section that faces forward when the upper section is in the upright storage position.

2. The upright surface cleaning apparatus of claim 1 wherein air exiting the suction motor travels axially through the post motor filter and then forwardly to the clean air outlet.

3. The upright surface cleaning apparatus of claim 1 wherein the post motor filter housing includes an openable portion and the openable portion is axially removable.

4. The upright surface cleaning apparatus of claim 1 wherein the post motor filter housing includes an openable portion that includes a sidewall and the post motor filter is positioned in the openable portion when the openable portion is opened.

5. The upright surface cleaning apparatus of claim 1 wherein the post motor filter is axially removable.

6. The upright surface cleaning apparatus of claim 1 wherein the post motor filter housing includes an openable portion that includes a sidewall and the clean air outlet is provided in the sidewall.

7. The upright surface cleaning apparatus of claim 1 wherein the post motor filter is a HEPA filter having axially extending pleats.

8. The upright surface cleaning apparatus of claim 1 wherein the post motor filter housing is openable by a hand operable closure member.

9. The upright surface cleaning apparatus of claim 1 wherein the post motor filter housing is openable by a hand operable rotatable closure member.

10. The upright surface cleaning apparatus of claim 3 wherein the post motor filter is concurrently axially removable with the openable portion.

11. The upright surface cleaning apparatus of claim 1 wherein the clean air outlet is provided only on a front and sides of the wall of the upper section that faces forward when the upper section is in the upright storage position.

12. The upright surface cleaning apparatus of claim 1 wherein the wall of the upper section that faces forward when the upper section is in the upright storage position has an absence of an air outlet on a rear side thereof.

* * * * *